United States Patent [19]

Crain et al.

[11] 3,992,806

[45] Nov. 23, 1976

[54] ANIMATED TOY

[75] Inventors: Philip Warren Crain, Redondo Beach; James Frank Woods, Yettem, both of Calif.

[73] Assignee: Mattel, Inc., Hawthorne, Calif.

[22] Filed: Jan. 26, 1976

[21] Appl. No.: 652,365

[52] U.S. Cl. ..... 46/116; 46/119

[51] Int. Cl.[2] ..... A63H 3/40

[58] Field of Search ..... 46/39, 116, 119, 120

[56] References Cited

UNITED STATES PATENTS

| | | | |
|---|---|---|---|
| 668,723 | 2/1901 | Westerman et al. | 46/116 |
| 1,038,603 | 9/1912 | Kuhl | 46/120 |
| 1,153,524 | 9/1915 | Schwarzschild | 46/116 |
| 1,643,001 | 9/1927 | Agnelli | 46/116 |
| 1,748,542 | 2/1930 | Demers | 46/116 |

*Primary Examiner*—Russell R. Kinsey
*Assistant Examiner*—Robert F. Cutting
*Attorney, Agent, or Firm*—Robert W. Mulcahy; Stephen L. King; Max E. Shirk

[57] ABSTRACT

An amusement device or toy is disclosed having a figurine positioned adjacent simulated toy machinery, such as a spinning wheel or potters wheel, with the machinery containing a rotatable component part or element. At least two spaced cam surfaces or lobes are included on the rotatable element. The arm of the figurine is placed so that the attached hand is placed proximate said rotating element so that when the part is rotated the cam lobes engage the hand of the figurine and undulates or shuttles the hand creating additional action for the amusement of the user.

4 Claims, 6 Drawing Figures

ANIMATED TOY

FIELD OF THE INVENTION

This invention relates to an improved animated amusement device or toy.

BACKGROUND OF THE INVENTION

Animated amusement devices of various types have heretofore been widely known and appreciated. In these types of devices means are employed to impart motion in toy machines and figurines to create action to interest and amuse the observer. By way of background in these types of devices, certain structures appearing in the patent literature have been made known to us which may be of some interest to the reader. These include the U.S. Pat. Nos. 659,555, 668,723, 1,391,158, 1,643,001, 1,565,716, 2,254,091, 2,683,954, 2,688,819, 2,884,200, 3,713,653 and 3,751,849.

As is apparent to the reader, those particular prior art devices, although quite interesting and worthwhile, appear to be of complex structure, and while capable of manufacture and assembly, the cost of those structures would, in the applicant's opinion, be relatively great, and that in turn limits their usefulness primarily to those of great wealth. Those who are parents are relieved that their children can find an amusement device that is desirable to the child and yet is inexpensive.

OBJECTS OF THE INVENTION

With those purposes in mind, the present invention is directed to an animated amusement device which provokes the interest of children and yet is of such novel structure that it is relatively easy to manufacture and is relatively inexpensive.

BRIEF SUMMARY

In accordance with the foregoing objects our invention includes a piece of toy machinery containing a rotatable part and a toy figurine juxtaposed thereto. The rotatable element includes at least two camlike or lobe surfaces. An arm of the figurine is positioned so that the attached hand is engaged by the camlike surfaces so that when the rotatable element is driven by suitable motive means the hand of the figurine is undulated or shuttled back and forth to depict action. The figurine motion is thus accomplished without the necessity of any direct connection to a driving source or complicated parts in the figurine itself.

In one specific embodiment, the machinery is a simulated spinning wheel containing a rotatable pulley having two cam surfaces angularly displaced about the pulley axis and located on opposite sides thereof. Moreover, the hand of the figurine is open so that the fingers are placed on one side of the pulley and the thumb is placed on the other side of the pulley so that as the pulley revolves during operation the cam surface on one side engages the fingers of the hand to move the hand in one direction along the axis of the pulley and, thereafter, during another angular position in the revolution of the pulley the second cam surface engages the thumb to move the hand in the opposite axial direction. In another embodiment of the invention, the machinery consists of a rotating pottery wheel and pot and cam surfaces are included on the outer side of the pot to engage and undulate the hand of the juxtaposed figurine.

The foregoing objects and advantages of the invention together with the structure characteristic of the invention is better understood by giving consideration to the detailed description of the preferred embodiments of the invention which follows, taken together with the figures of the drawings.

DESCRIPTION OF THE DRAWINGS

In the drawings.

FIGS. *3a*, *3b* and *3c* illustrate the cooperation between the pulley of the spinning wheel and the hand of the figurine for different positions of the pulley.

DETAILED DESCRIPTION

Figure 1:
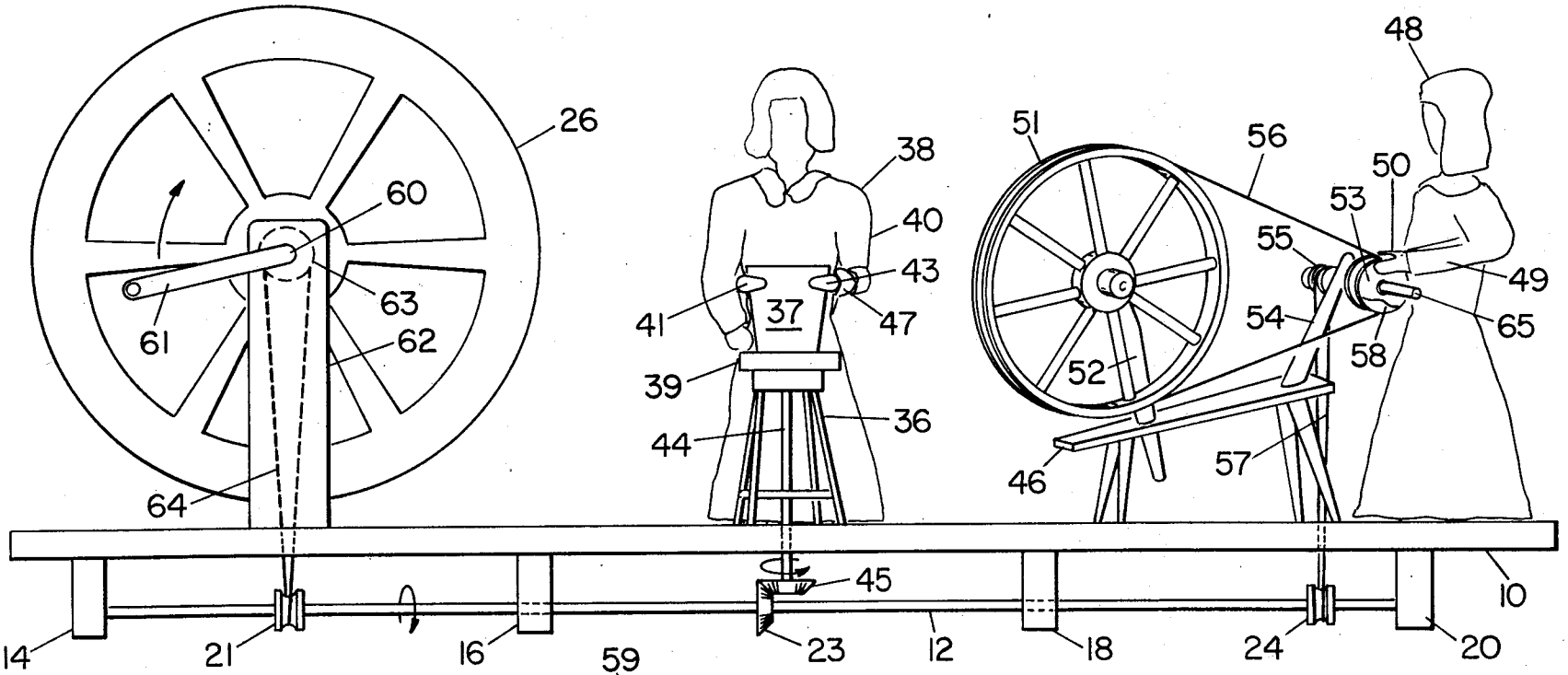
FIG. 1 illustrates the invention partially in perspective and partially schematically.

The overall combination illustrated in FIG. 1 includes a base platform 10, partially illustrated. An elongated straight shaft 12 is rotatably mounted to the underside of platform 10 by suitable shaft journals, such as is symbolically illustrated at 14, 16, 18 and 20, or equivalent means. The shaft includes a first pulley 21, a first gear 23, and a second pulley 24. A simulated waterwheel 26, a simulated potters wheel assembly 36, and an attendant figurine 38, a simulated spinning wheel assembly 46 and a second attendant figurine 48 are mounted on top of platform 10.

The potters wheel assembly 36 includes a pot 37 attached to a rotatable wheel 39. The pot contains two camlike lobes 41 and 43 spaced from one another on the outer peripheral surface of the pot. A shaft 44 extends through an opening in platform 10, not illustrated, to a gear 45 which in turn operatively engages gear 23 of shaft 12. The other end of shaft 44 is connected to the rotatable wheel 39. The associated figurine 38 is positioned so that the attached hand 47 of arm 40 engages the side of pot 37 in the path of movement of lobes 41 through 43. The figurine is constructed of any suitable material so that the hand or the entire arm may be flexed or undulated sideways and the feet of the figurine are attached to platform 10.

The spinning wheel 46 simulates the well known apparatus and includes a stand and four legs, as shown. A main wheel 51 is rotatably mounted to a support 52 extending from the base. The wheel contains a ground peripheral surface. A second wheel pulley 53 is rotatably mounted to a shaft 65 which is supported for rotation by rod 54 attached to the spinning wheel assembly base. Shaft 65, to which pulley 53 is attached, is also connected with another pulley 55. Pulleys 51 and 53 are connected together by a belt 56. A second belt 57 extends from pulley 55 through a cutaway portion in the base of the spinning wheel and through an opening in base 10 for operative engagement with pulley 24 attached to shaft 12. Pulley 53 contains two camlike lobes, one on each side of the pulley adjacent the outer rim, only one of which, 58, is visible in this figure. Figurine 48 includes an arm 49 having an open hand 50 held about the pulley 53 with the thumb on one side of the pulley and the fingers shown in FIG. 1 on the other side of the pulley. Figurine 48 is attached either in a sitting or standing position relative to base 10 so that the aforedescribed relationship is maintained. The arm of the figurine or the hand is sufficiently flexible to allow undulating motion sideways relative to the torso of the figurine. As is apparent from this figure, as pulley 53 rotates, the camlike lobe 58 engages the fingers and forces the hand in one direction along the pulley axis while at another position of revolution the camlike surface on the other side engages the thumb to force the hand in the opposite direction along axis of the pulley.

The simulated waterwheel is mounted on a shaft for rotation about an axis 60. Coupled to this shaft is a crank 61. Suitably the shaft is supported to base 10 by a support member 62. A pulley 63 is located within the support member 62 as indicated by the dash lines. A belt 64 engages pulley 63 and extends through an opening in base 10, not illustrated, and engages pulley 21 on shaft 12.

The various parts illustrated may be constructed of suitable materials as is self-evident, including plastic and metal, and perhaps rubber for the pulley belts.

Figure 2:
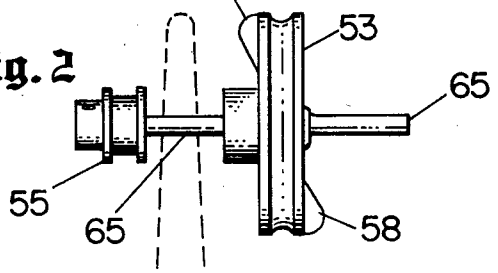
FIG. 2 illustrates a modified pulley of the spinning wheel employed in the embodiment of FIG. 1.

To provide greater clarity the spinning wheel assembly pulley 53 is illustrated in greater detail in FIG. 2. The pulley includes the one cam surface which protrudes as a lobe axially and a second cam surface 59 on the other face of the pulley extending axially in the opposite direction. The hub of the pulley is mounted to a shaft 65. Similarly the other pulley 55 is mounted to shaft 65.

Figure 4:
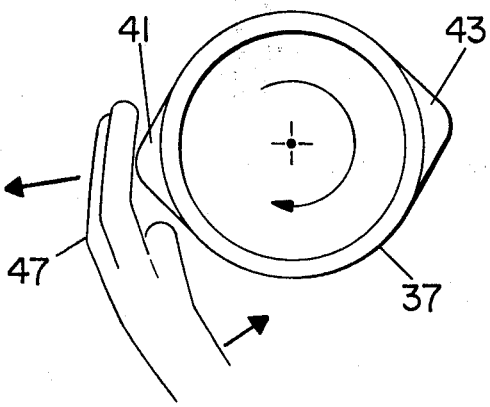
FIG. 4 illustrates schematically the cooperation between the hand of the figurine and the rotating pot illustrated in FIG. 1.

In operation, the turning of crank 61 rotates the water wheel 26 about axis 60 and in turn, by means of pulley 63, belt 64 and pulley 21, shaft 12 is rotated. Shaft 12 by means of gear 23 engages and rotates gear 45 and thereby through the interconnected shaft 44 rotates the potters wheel 39 and the attached pot 37. As the pot rotates, the camlike surface 41 engages the hand 47 of the figurine and forces it outward. As the camlike portion rotates past the hand, the hand moves back through inherent resiliency of the material to engage the pot surface. Thereafter, as the pot continues to rotate, camlike lobe 43 similarly engages hand 47, forcing it outwardly. Thus, as the pot rotates, the hand 47 of the figurine appears to move to and fro or undulates. Reference is made to FIG. 4 illustrating the camlike surface on pot 37 somewhat exaggerated to show engagement with hand 47 at various rotational positions of the pot 37 with cam surfaces 41 and 43.

Figure 3A:
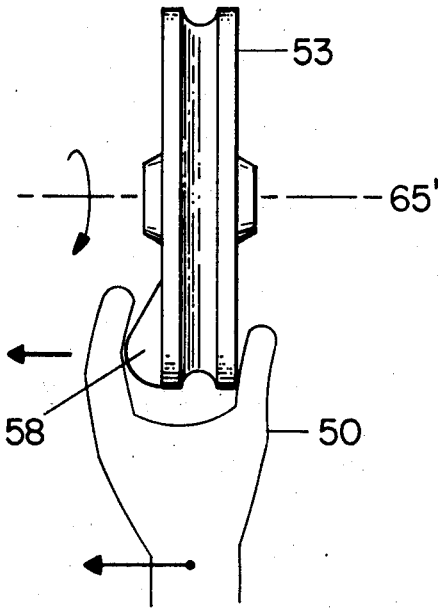
Figure 3B:
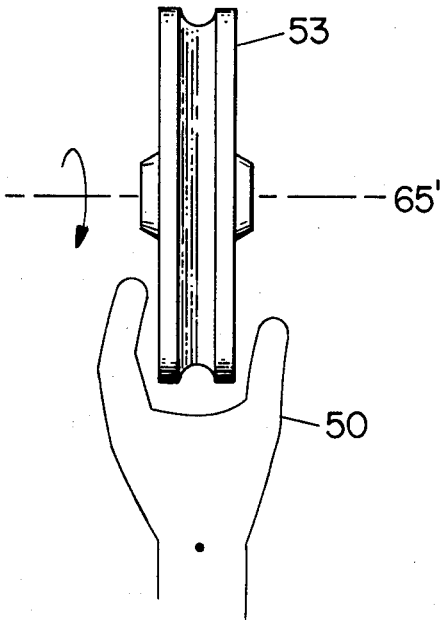
Figure 3C:
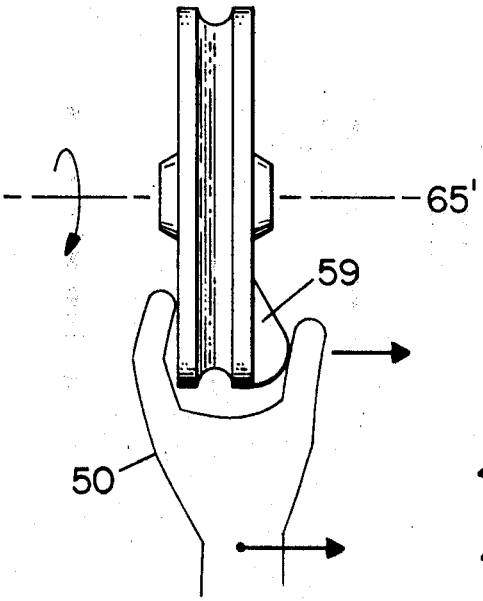

Similarly, as shaft 12 rotates and causes pulley 24 to turn, pulley 24 via belt 57 drives pulley 55 of the spinning wheel assembly, which through shaft 65 drives pulley 53. In turn, pulley 53 drives the main spinning wheel 51 by means of the belt 56. As pulley 53 rotates, the camlike surface 58 engages the fingers of hand 50 and forces the hand axially outward. As the pulley continues to rotate through inherent resiliency, the hand restores to an engagement with the pulley. Further, during the course of rotation, the camlike surface on the other side engages the finger of the hand to force the hand axially in the opposite direction to thereby cause a back and forth movement or undulation of the hand of figurine 48. Reference is made to FIG. 3*a* which illustrates pulley 53 in several stages of rotation about its axis 65'. As cam 58 comes into contact with the fingers of hand 50, the cam forces the hand to the left, as shown in FIG. 3*a*. As pulley 53 continues to rotate, the hand moves back to a neutral position as shown in FIG. 3*b*, and cam 59 on the opposite surface appears to engage the thumb, moving hand 50 along axis 65' to the right, as illustrated in the figure.

As is apparent from the foregoing illustrations we have devised an animated toy which employs simulated machinery used in the past containing a rotatably mounted element having at least two spaced camlike surfaces. When rotated by suitable driving means, as illustrated, the rotatable element alternately engages the hand or portion thereof of an associated figurine to undulate the hand and the arm. In so doing, a simple figurine is employed without requiring any complicated mechanical construction to the figurine to affect its movement. Thus the figurines may be simply manufactured without any special consideration, using conventional techniques and fastened in place. Moreover, the entire organization of our invention is of a simple, direct, and inexpensive construction in that a single straight shaft 12 is employed having suitable gears and pulleys so that complicated bends or turns in the driving mechanisms which would increase the cost of manufacture and assembly is simply avoided.

It is believed that the foregoing description of an embodiment of our invention is sufficient in detail to enable one skilled in the art to make and use same. It is understood however that our invention is not to be confined to the details or ornament employed in connection with the foregoing illustrations and descriptions of the invention since many equivalents as well as improvements will suggest themselves to one skilled in the art upon reading this specification.

Accordingly it is expressly understood that our invention is to be broadly construed within the full scope of the appended claims.

What is claimed is:

1. An animated amusement device comprising, in combination:

a base;

a simulated machine apparatus located on said base and having a rotatable element;

means for rotating said element;

a plurality of cam surfaces located on said rotatable element and spaced from one another;

a figurine located on said base adjacent said rotating element, said figurine having an extending arm and a hand attached to an end of said arm;

said hand being positioned in contact with said rotating element in the path of movement of said cam surfaces;

whereby rotation of said element undulates said hand.

2. The invention as defined in claim 1 wherein said simulated machinery comprises:

a spinning wheel assembly having a driving wheel and a driven wheel;

said driving wheel being axially rotatable and having a first lobe formed on one side of said wheel in an axial direction and a second lobe extending axially in the other direction located on the other side of said wheel angularly spaced from said first lobe, and wherein said hand of said figurine comprises a set of fingers and a thumb held spaced from one another by a distance greater than the width of said wheel by less than the axial distance between the peaks of said cams, said hand located fitted over said wheel so that one of said cams engages and axially displaces said fingers when the wheel is in a first position and engages and axially displaces said thumb when said wheel is in a second position.

3. The invention as defined in claim 1 wherein said element comprises a simulated pot attached to a potters wheel, said pot having a pair of spaced cam surfaces and means biasing said hand of said figurine in contact with said surface of said pot for engagement with said cam surfaces during revolution of said pot.

4. An animated amusement device comprising:

a platform base;

a straight shaft mounted beneath said base containing a first pulley, a first gear and a second pulley spaced apart from one another;

a crank decorated to simulate a water wheel rotatably mounted on top of said base and operatively coupled to a third pulley;

belt means coupling said third pulley to one of said pulleys on said shaft for rotating said shaft;

a simulated potters wheel located atop said base spaced from said water wheel, having a rotatable top and a pot attached to said top for rotation therewith, said pot containing two cam lobes spaced apart on the outer periphery thereof;

shaft means extending through said base and connecting said rotatable table top through said base to a second gear means, said second gear means being operatively coupled to said first gear means for concurrent rotation with said main shaft;

a figurine attached to said base in proximity to said pot, said figurine having an extending hand in proximate contact with the outer periphery of said pot and in the path of movement of said camlike surfaces, whereby said hand may be undulated by rotation of said pot;

a spinning wheel assembly mounted atop said base including a main pulley-like spinning wheel and a second pully-like spinning wheel operatively connected to them by a belt means;

a fourth pulley wheel connected for concurrent rotation with and for driving said second pulley-like spinning wheel and belt means engaging said second pulley on said shaft and said fourth pulley, said belt means extending through said base for driving said fourth pulley from said shaft;

said second pulley-like spinning wheel containing two camlike lobes angularly spaced from one another, with one lobe located on each pulley face, whereby said lobes protrude in opposite axial directions;

a second figurine coupled to said base located in proximity to said spinning wheel assembly, said figurine having an extending arm having a formed open hand in which the fingers are spaced apart from the thumb so as to simulate a grip on said second pulley-like spinning wheel, said fingers being mounted in the path of movement of one of said lobes on one side of said second pulley and second thumb being located in the path of movement of said second lobe on the opposite side of said pulley;

whereby movement of said second pulley-like spinning wheel causes said hand to undulate back and forth in an axial direction.

* * * * *